United States Patent [19]

Sawatani et al.

[11] Patent Number: 4,515,644

[45] Date of Patent: May 7, 1985

[54] METHOD FOR PRODUCING FERRITIC STAINLESS STEEL SHEETS OR STRIPS CONTAINING ALUMINUM

[75] Inventors: Tadashi Sawatani, Tokyo; Mitsuo Ishii, Hikari; Hirofumi Yoshimura; Jirou Harase, both of Munakata, all of Japan

[73] Assignee: Nippon Steel Corporation, Japan

[21] Appl. No.: 312,848

[22] Filed: Oct. 19, 1981

[30] Foreign Application Priority Data

Oct. 21, 1980 [JP] Japan ..... 55-146377
Oct. 21, 1980 [JP] Japan ..... 55-146378

[51] Int. Cl.[3] ..... C21D 8/04
[52] U.S. Cl. ..... 148/12 EA
[58] Field of Search ..... 148/12 EA

[56] References Cited

U.S. PATENT DOCUMENTS 3,713,812 1/1973 Brickner et al. ..... 148/12 EA
3,850,703 11/1974 Kalita ..... 148/12 EA

*Primary Examiner*—W. Stallard
*Attorney, Agent, or Firm*—Wenderoth, Lind & Ponack

[57] ABSTRACT

The ferritic stainless steel sheet involves a problem that the ridging is likely to generate at the forming step, such as the deep drawing step. The ridging is believed to be caused by a band structure in the hot rolled band, which structure exerting an influence on the formability of a cold rolled sheet. The ridging is prevented in the present invention by means of the combination of the three technical measures: incorporating aluminum into a ferritic stainless steel; heating a slab to a low temperature of 1200° C. or less; and, carrying out a drastic hot rolling of at least one pass with the draft of 20%/pass or more. As a result of these technical measures, the structure of a hot rolled band is made and uniform and thus both the formability and anti-ridging property are enhanced.

13 Claims, 10 Drawing Figures

METHOD FOR PRODUCING FERRITIC STAINLESS STEEL SHEETS OR STRIPS CONTAINING ALUMINUM

The present invention relates to a method for producing a ferritic stainless steel containing aluminum.

The ferritic stainless steel sheet is widely used for various kitchenware, automobile parts and the like upon subjecting the cold rolled sheet to a deep drawing and other forming methods. The ferritic stainless sheet involves, however, a problem of ridging occurring at the forming step thereof. Considerable research has hitherto been directed to discovering the cause of ridging, and, according to the present predominant theory, a band structure present in the hot rolled strip is the main cause of the ridging. According to this theory, it is considered that the band structure, which is massive, elongated in the rolling direction and consisting of bands having crystallographic orientations close to each other, is formed in the hot rolled strip at the center as seen in the short width direction of the strip. And, even at a later stage when the ferritic structure of the steel sheets or strips is made fine and uniform by subjecting the steel sheets or strips to the cold rolling and annealing step, the band structure, which seems to result from hot rolling or the cast structure of ferritic stainless steel, still maintains its influence, so that ridging is generated at the forming step, such as the deep drawing step, due to the plastic anisotropy based on the inherent orientation of the band structure.

Conventionally, all measures to eliminate ridging contemplate breaking up or decreasing the band structure mentioned above. British Pat. No. 1,246,772 discloses a composition of ferritic stainless steel which prevents ridging due to boron and columbium contained in such steel. However, this patent neither mentions that the ridging can be prevented by aluminum nor teaches to incorporate aluminum in a specific ratio to the nitrogen content. The present inventors proposed in Japanese Patent Application No. 48539/1979 to incorporate aluminum into a ferritic stainless steel and to hold a slab of this steel at a temperature of from 950° to 1100° C., followed by hot rolling, thereby improving the anti-ridging property of the ferritic stainless steel. In addition, in Japanese Published Patent Application No. 44888/1976, it is proposed to incorporate up to 0.2% of aluminum into a ferritic stainless steel, thereby providing the steel with good press-formability and corrosion resistance.

As an index of the press formability, such as the deep drawability, of a steel sheet the Lankford value (r value) and the height of ridging appearing on the steel sheets or strips are used. It is generally considered that, in order to ensure good formability, the average r value ($\bar{r}$ value) should be not less than about 1.1 and the ridging height should be not more than 18$\mu$ (microns).

It is an object of the present invention to provide a method for producing ferritic stainless steel sheets or strips with improved anti-ridging property and press formability, especially with the good formability as mentioned above. The method of the present invention should allow production of ferritic stainless steel sheets or strips with good deep drawability by subjecting the hot rolled band to continuous annealing for a short period of time instead of a conventional box annealing for a long period of time.

The method of the present invention is characterized in that the slab of a ferritic stainless steel containing aluminum is heated to and held at a temperature of not more than 1200° C., and then hot rolled at at least one pass of screw down at a draft of not less than 20%/pass. In the present invention, a slab of a ferritic stainless steel containing aluminum is heated to and held at a low temperature, namely not more than 1200° C., and desirably not less than 900° C., and then hot rolled by a large draft, namely not less than 20%/pass at at least one pass. The reason for this will be understood from FIG. 1.

Figure 1:
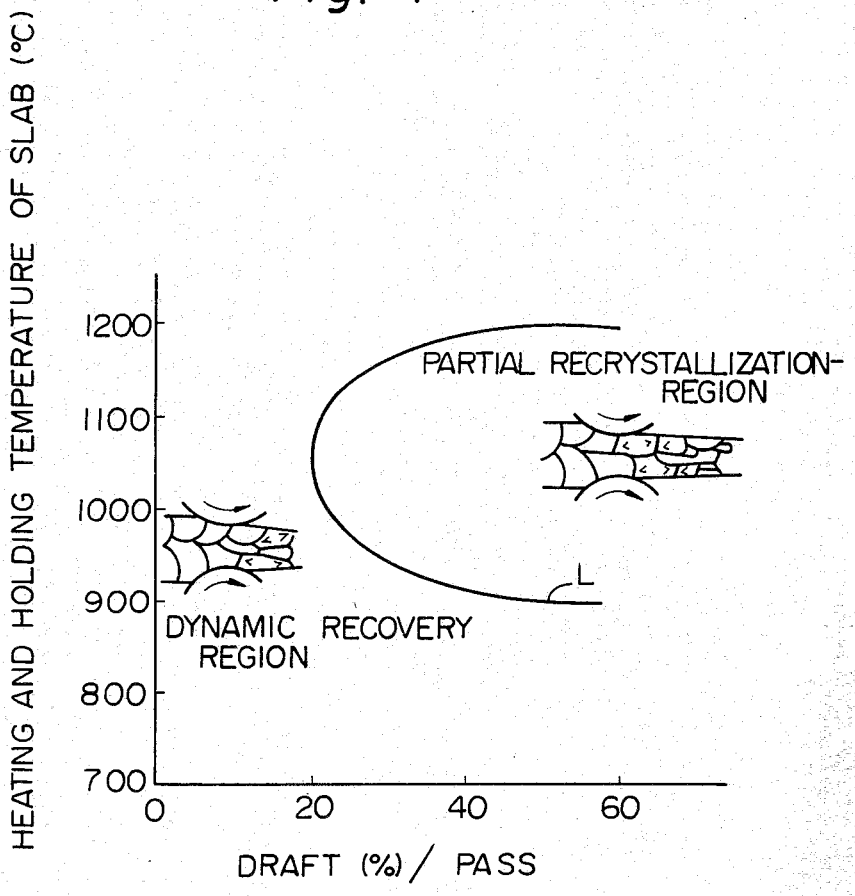
FIG. 1 is a schematic drawing to illustrate an appropriate hot-rolling condition according to the present invention.

Referring to FIG. 1, the influence of the draft and the heating and holding temperature of a slab upon recrystallization is schematically illustrated. According to the discovery by the present inventors, a ferritic stainless steel, which contains aluminum, preferably up to 0.2%, is partially recrystallized in the region or range defined by the draft and the heating and holding temperature and denoted by "L" in FIG. 1. In the region L, this steel becomes not a completely but partially recrystallized structure during the hot rolling. On the other hand, in the region outside "L", not recrystallization but only the dynamic recovery of the hot rolled structure of a slab takes place.

A ferritic stainless steel containing aluminum is known, for example, British Pat. No. 1,217,933. This patent describes a ferritic stainless steel containing from 12 to 28% of chromium, from 0.01 to 0.25% of carbon, from 0 to 3% of silicon, from 0 to 5% of aluminum, from 0 to 3% of molybdenum, from 0 to 2% of cobalt and from 0 to 2% of manganese. However, the object of this patent is to improve of the surface quality of the ferritic stainless steel. In addition, the proportion of the aluminum to the nitrogen content is not considered in this patent.

British Pat. No. 760,926 aims to improve the hot workability of a high alloy chromium steel with chromium content ranging from 10 to 35% and with total alloy contents of at least 25% nickel, cobalt, manganese, molybdenum, copper and aluminum in addition to the chronium, by means of incorporating titanium, zirconium, vanadium and the like into such steel. The hot rolling conditions specifically mentioned in this patent are those of austenitic stainless steels.

British Pat. No. 1,162,562 discloses that aluminum reduces the yield point and improves the formability of a ferritic stainless steel. However, this patent neither specifically discloses a hot rolling condition and nor teaches that a hot band annealing can be carried out in a continuous annealing furnace.

From the point of view that nitrides of aluminum and the like are precipitated at the hot rolling step in a desired quantity and morphology, the heating and holding temperature of a slab prior to the hot rolling is desirably from 900° to 1200° C. The precipitating quantity of, for example AlN, which is one of the precipitates, is the greatest at approximately 800° C., while the dissolving tendency of AlN, which is solid-dissolved into the matrix, becomes appreciable, when heating the Al-containing ferritic steel higher than approximately 800° C., and most AlN is solid-dissolved into the matrix at 1350° C. or higher. When the heating and holding temperature of a slab exceeds 1200° C., the precipitating quantity of AlN and the like is too small to achieve beneficial results of the precipitates on the recrystallization.

The lowest heating and holding temperature of a slab is restricted by the installation requirements, that is, when the heating and holding temperature is below 900° C., it is difficult to reduce the thickness of a steel plate to the requisite thickness due to the temperature drop of the steel plate during hot rolling.

The inventive concept of the present invention, as understood in the light of the above explanation and also of the conventional maximum draft of ferritic stainless steel at hot rolling, i.e. 20%, resides in the fact that: in order to eliminate the band structure having undesirable orientation or to suppress the formation of such structure, aluminum is incorporated into a ferritic stainless steel; and, the partial recrystallization structure is developed during the hot rolling by means of hot rolling with high draft and a controlled heating and holding temperature of the slab.

It is preferred that the ferritic stainless steel contains from 15 to 20% of chromium and aluminum in an amount up to 0.2% and at least twice the nitrogen content. Aluminum in an amount of 0.01% is sufficient for incorporating the same into steels for the deoxidation purpose, however, at least 0.01% of aluminum is necessary for effectively using the aluminum as a component of nitrides, such as AlN and the like. Ferritic stainless steel containing aluminum has a particularly enhanced ductility and r value as well as a particularly improved anti-ridging property, when the ratio of aluminum to nitrogen {Al(%)/N(%)} is at least 2. When the aluminum content exceeds 0.2%, the forming property, such as deep drawability, tends to be saturated or slightly impaired, which is not advantageous. The aluminum content according to the present invention is, therefore, not more than 0.2%.

When chromium is used in an amount less than 15%, the corrosion resistance is not sufficient for such a corrosive environment as the ferritic stainless steel is to be used. On the other hand, the elongation and impact value of the ferritic stainless steel with a large amount of chromium are impaired. Considering this, the chromium amount is from 15 to 20% in the present invention.

It is also preferred that the ferritic stainless steel contains up to 0.2% of aluminum, from 15 to 20% of chromium, from 0.005 to 0.6% of titanium and from 0.0002 to 0.0030% of boron. In this steel, which additionally contains titanium and boron in addition to aluminum, the deep drawability is further enhanced due to the synergistic effect of aluminum, boron and titanium. Incidentally, titanium is also effective for improving the hot workability of ferritic stainless steel. The effects of boron, which enhances the elongation, average r value and deep drawability and which also improves the anti-ridging property, are appreciable, if the boron content is at least 2 ppm, and it tends to saturate or slightly decrease if the boron content is more than 30 ppm. In addition, when the boron content exceeds 30 ppm, boron compounds are precipitated in the boundaries of the ferrite grains, which causes such problems as deterioration of both the corrosion resistance and hot workability to arise. Furthermore, the incorporation of boron at an amount more than 30 ppm is economically disadvantageous. The maximum boron content is, therefore, 30 ppm.

Titanium, which is a former of stable carbide, enhances the deep drawability, because titanium makes the ferrite grains fine and uniform and enhances the elongation and ductility. The anti-ridging property of ferritic stainless steel is enhanced, particularly when titanium is incorporated into the Al-B-containing ferritic stainless steel. In addition, the content of boron and aluminum can be decreased by the incorporation of titanium into the Al-B-containing ferritic stainless steel, and such decrease is very advantageous in view of the formability of such steel. Titanium appreciably enhances the deep drawability and appreciably improves the anti-ridging property if used at a content of 0.005% or more. On the other hand, at a content exceeding 0.6% the enhancement of deep drawability of the Al-B-containing ferritic stainless steel is saturated. The incorporation of more than 0.6% of titanium is insignificant from the view point of formability of the ferritic stainless steel and also disadvantageous economically. The titanium content is, therefore, from 0.005 to 0.6% with regard to the Al-B-containing ferritic stainless steels.

Aluminum is also effective for improving the corrosion resistance of the ferritic stainless steel and also promotes material uniformity due to grain refinement. The aluminum content, at which this effect becomes appreciable, is decreased to a small amount, i.e. 0.005%, by means of the combined addition of boron and titanium into the Al-containing ferritic stainless steel. In the Al-Ti-B-containing ferritic stainless steel, the corrosion resistance and formability are superior if the range of aluminum content is from 0.005% to 0.2% but they become inferior if the aluminum content is more than 0.2%. In addition, the incorporation of more than 0.2% of aluminum is economically disadvantageous. The maximum aluminum content in the Al-Ti-B-containing ferritic stainless steel should, therefore be 0.2%.

An additional incorporation of one or more elements of: the group consisting of niobium, vanadium and zirconium; the group consisting of calcium and cerium; and, copper in addition to the incorporation of aluminum, boron and titanium into the ferritic stainless steel further enhances the formability and improves the deep drawability due to a synergistic effect of these elements.

Niobium, vanadium and zirconium are formers of stable carbonitrides just as titanium is and they bring about enhancement of the r value and improvement of the anti-ridging property. An appropriate incorporation range of niobium, vanadium and zirconium is from 0.005 to 0.40% because of reasons similar to those for the incorporation of titanium.

Copper is not a former of carbonitrides as titanium and the like are, and copper is precipitated alone or as metallic copper. The precipitation behaviour of copper is somewhat different from that of titanium and the like. Copper in the course of its precipitation has, however, a significant influence upon the recrystallization of steel sheets with the result that the deep drawability of ferritic stainless sheets is improved. The content of copper is limited to the range of from 0.02 to 0.50%, because the effects of copper incorporation is appreciable at at least 0.02%, and further because the deterioration of hot workability, caused by the inherent effect of copper on the steel material, becomes disadvantageously conspicuous at a content exceeding 0.50%.

Calcium, which is a strong deoxidizer, enhances the ductility of steel sheets and is simultaneously effective for mitigating the anisotropy of the steel sheets or strips due to the formation of spheroidal calcium-inclusions. The calcium, therefore, contributes to the promotion of a uniformity of formability, such as deep drawability. When, however, a large amount or more than 0.05% of calcium is incorporated into steels, the oxides resultant from calcium remain in the steels in a large amount as non-metallic inclusions and thus impair the cleanness and formability of ferritic stainless steel.

The maximum content of cerium is also 0.05% because of reasons similar to those for limiting the maximum content of calcium to 0.05%.

In the case of a ferritic stainless steel, where the composite nitride-forming elements, e.g. boron and titanium are incorporated in addition to aluminum, it is considered that the precipitation behaviour of nitrides, which are not merely AlN but composite nitrides, is similar to that in the ferritic stainless steel containing aluminum as the nitride-forming element.

The heating and holding tempterature of a slab and hot rolling condition according to the present invention will now be explained in detail.

The slab of ferritic stainless steel to be subjected to hot rolling according to the present invention may be either one resultant from roughing of an ingot or a continuously cast slab. The slab should preferably have an equiaxed crystal ratio ($\theta$) of not less than 50%. Incidentally, an anisotropy of the cast structure in the continuously cast slab causes a significant ridging generation in the ferritic stainless steel sheet, and an equiaxed crystal ratio ($\theta$) of more than 75% can be hardly obtained in the continuously cast slab. However, such ridging can be very effectively prevented through procedures carried out in accordance with the present invention.

Figure 2:
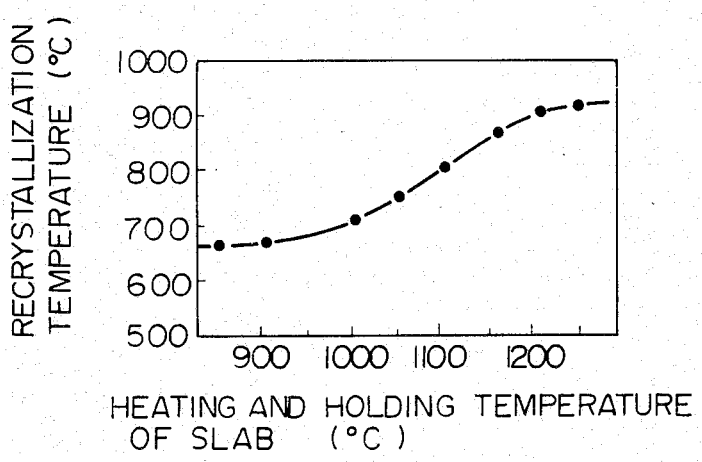
FIG. 2 is a graph illustrating the relationship of the recrystallization temperature depending upon the heating and holding temperature of a slab.
Figure 3:
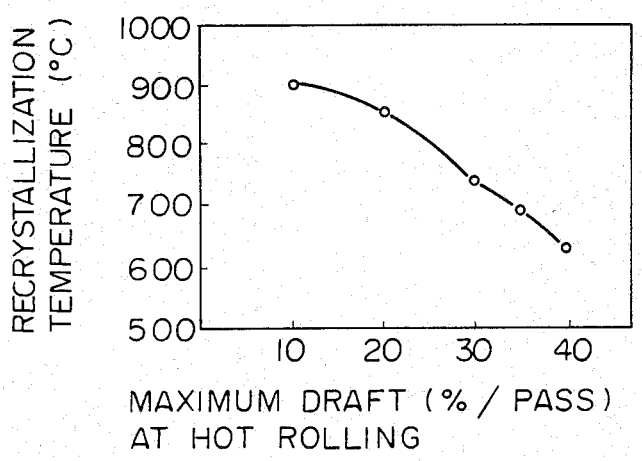
FIG. 3 is a graph illustrating the relationship of the recrystallization temperature depending upon the maximum draft (%/pass) at hot rolling.

It is preferred in a method of the present invention that the ferritic stainless steel containing aluminum is heated to and held at a temperature of not more than 1200° C., then hot rolled at at least one pass having a draft of not less than 20%/pass, and the resultant hot rolled band is successively subjected to a continuous annealing, cold rolling and finishing annealing. It is intended in this method that, in order to further eliminate the plastic anisotropy, the unrecrystallized part of the ferritic stainless steel, which has been partially recrystallized during the hot rolling, is recrystallized by the continuous annealing. The present inventors confirmed by experiments that the recrystallization temperature of the steel sheets after hot rolling has a close relationship depending upon both the heating and holding temperature of a slab and the maximum draft per pass during the hot rolling. Referring to FIG. 2, the relationship of the recrystallization temperature depending upon the heating and holding temperature of a slab is graphically illustrated. Referring to FIG. 3, the relationship of the recrystallization temperature depending upon the maximum draft (%/pass) at hot rolling is graphically illustrated, with regard to the slabs of Sample 1, which were heated to and held at a temperature of 1050° C. Both graphs were obtained as a result of experiments performed by the present inventors. As is indicated in FIG. 2, a lower temperature for heating and holding of a slab results in a lower recrystallization temperature of the ferritic stainless steel, which allows a low temperature annealing of a hot rolled band. The recrystallization temperature, however, tends not to be changed substantially by a decrease in the heating and holding temperature of a slab to a level less than 900° C. In addition, at a temperature less than 900° C., the screw down load of the rolling tends to be higher from the view point of higher deformation resistance of the ferritic stainless steel and also the rolling becomes difficult. Therefore, the heating and holding temperature of a slab is desirably not less than 900° C.

As is indicated in FIG. 3, the high maximum draft (%/pass) results in a lower recrystallization temperature of the ferritic stainless steel, which also allows a low temperature annealing of a hot rolled band. However, when this annealing is carried out at a temperature less than 700° C., the hot rolled band is not likely to recrystallize. On the other hand, when this annealing is carried out at a high temperature, i.e. 1050° C. or higher, the grain coarsening and a partial generation of austenite phases in the ferrite matrix are likely to occur during annealing, with the result that ductility of steel sheets is deteriorated after annealing.

As understood from FIG. 2, the recrystallization temperature of the ferritic stainless steel with aluminum as the major incorporating element (e.g. Sample No. 1 given in Table 1, below) was about 700° C., when the heating and holding temperature of a slab was 1000° C. From the experiment results not shown in the drawings, the recrystallization temperature of the ferritic stainless steel (e.g. Sample No. 16 given in Table 7, below) with aluminum, titanium and boron as the major incorporating elements was about 800° C., when the heating and holding temperature of a slab was 1000° C.

Preferable annealing conditions of a hot rolled band are:

annealing at a temperature range of from 700° to 1050° C. for ferritic stainless steel containing up to 0.10% of carbon, up to 0.025% of nitrogen, from 15 to 20% of chromium, and at least 0.01% of aluminum, with the proviso of the minimum aluminum content being twice the nitrogen content $\{Al(\%) \geqq N(\%) \times 2\}$; and, annealing at a temperature range of from 800° to 1050° C. for ferritic stainless steel containing up to 0.10% of carbon, up to 0.025% of nitrogen, from 15 to 20% of chromium, from 0.005 to 0.2% of aluminum, from 0.005 to 0.6% of titanium and from 0.0002 to 0.0030% of boron.

Figure 4:
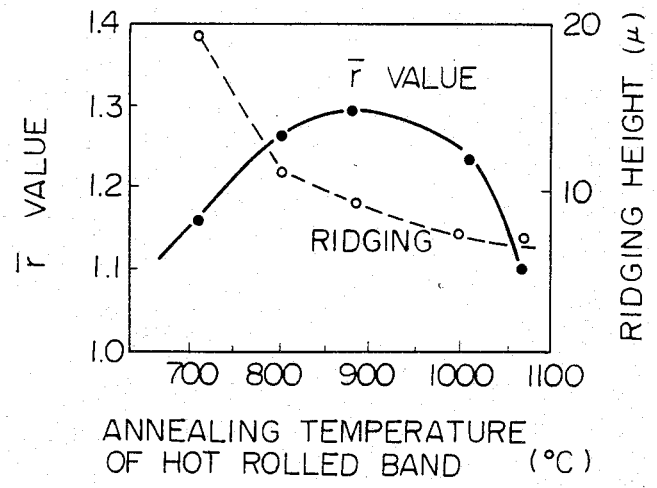
FIG. 4 is a graph illustrating the relationship of both the $\bar{r}$ value and the ridging height depending upon the annealing temperature of hot rolled band.

Referring to FIG. 4, the relationship of the $\bar{r}$ value and ridging height depending upon the annealing temperature is illustrated with regard to an example where a slab of ferritic stainless steel (Sample No. 13 given in Table 5, below) with aluminum as the major incorporated element was heated to 1050° C. and hot rolled at the maximum draft of 30%/pass. As indicated in FIG. 4, the $\bar{r}$ value and the ridging height become inferior at an annealing temperature of less than 700° C. and the $\bar{r}$ value becomes inferior at the annealing temperature of the hot rolled band at more than 1050° C.

In the continuous annealing of a hot rolled band, it is possible to use the following heat treatment patterns.

N pattern: the hot rolled band is heated to a temperature of from 700° to 1050° C. ($H_1$ temperature) so as to recrystallize the hot rolled band and then it is cooled down to a temperature of from 700° to 900° C. ($H_2$ temperature) at a cooling rate of not more than 15° C./second, followed by cooling to room temperature.

S pattern: the hot rolled band is heated to the $H_1$ temperature and is rapidly cooled to room temperature directly after heating to the $H_1$ temperature or after holding it at the $H_1$ temperature over a time period preferably at least 2 seconds. The cooling rate after the hot rolled band annealing is decided considering the intergranular corrosion resistance of the ferritic stainless steel, the index of which corrosion resistance being the corrosion weight loss in a 65% nitric acid solution. The cooling rate after holding it at the annealing temperature over a period of at least 1 minute is desirably not less than 5° C./second.

Figure 5:
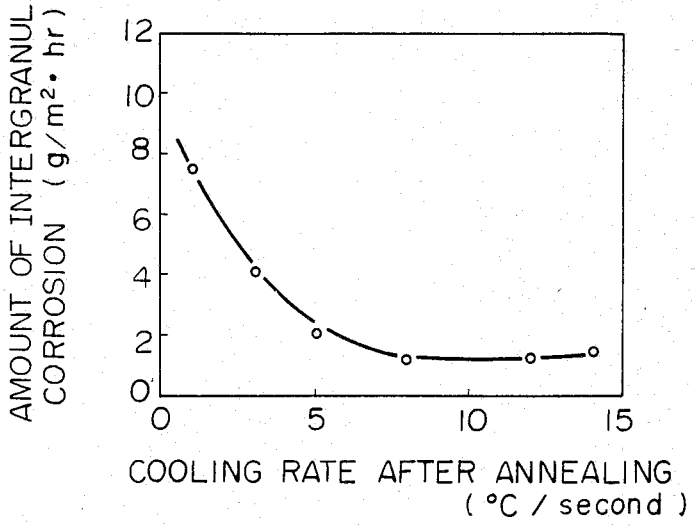
FIG. 5 is a graph illustrating the relationship of the amount of intergranular corrosion (g/m$^2$/hr) depending upon the cooling rate after the annealing (°C./second)

Referring to FIG. 5 the relationship of intergranular corrosion resistance upon the cooling rate is graphically illustrated with regard to Sample No. 12 given in Table 5 below. Generally in ferritic stainless steel, the chromium carbonitrides are precipitated in the grain boundaries, and a depletion layer of chromium is disadvantageously formed around the chromium carbonitrides, when the cooling rate after annealing is low. However, in Sample No. 12, the aluminum content is sufficiently high for precipitating aluminum nitrides instead of precipitating nitrogen as chromium nitrides, with the result that the depletion layer of chromium can be suppressed. A similar suppression effect is also realized by using titanium and boron.

In the box annealing of hot rolled bands, the coiled bands are placed in a box annealing furnace using a conventional technique and are annealed at a temperature of from 800° to 850° C.

The present invention is hereinafter explained by way of Examples.

EXAMPLE 1

Steels given in Table 1, below, were melted and continuously cast in order to obtain an equiaxed crystal ratio of the resultant CC (continuous cast) slabs a mounting to 50% or more ($\theta \geqq 50\%$).

TABLE 1

| Sample Nos. | Chemical Composition (%) C | Si | Mn | p | S | Ni | Cr | Al | N | Equiaxed Crystal Ratio $\theta$ (%) |
|---|---|---|---|---|---|---|---|---|---|---|
| 1 | 0.06 | 0.29 | 0.16 | 0.022 | 0.008 | 0.12 | 16.50 | 0.05 | 0.0102 | 59 |
| 2 | 0.05 | 0.28 | 0.15 | 0.023 | 0.007 | 0.11 | 16.51 | 0.18 | 0.0097 | 62 |
| 3 | 0.05 | 0.31 | 0.14 | 0.024 | 0.007 | 0.12 | 16.48 | 0.22 | 0.0101 | 62 |
| 4 | 0.06 | 0.30 | 0.16 | 0.025 | 0.006 | 0.12 | 16.51 | 0.30 | 0.0110 | 61 |

Figure 6:
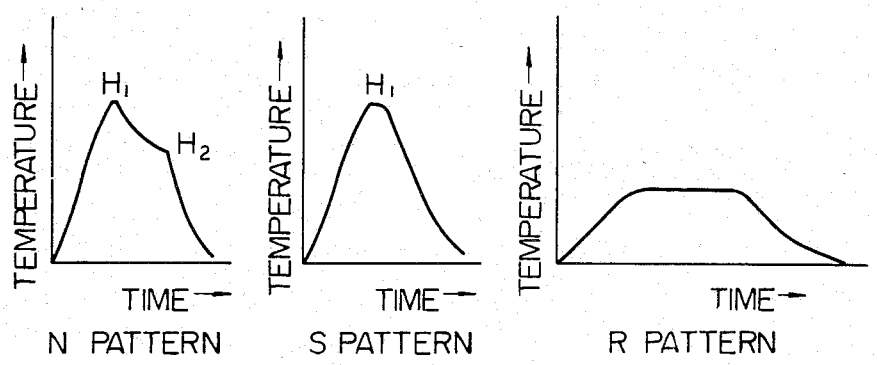
FIG. 6 is an annealing diagram of a hot rolled band.

In a heating furnace, the CC slabs were heated to and held at, at temperatures of 1000°, 1050°, 1180° and 1220° C. and then hot rolled in such a screw-down manner that the draft of at least one pass amounted to from 10%/pass to 40%/pass at the maximum. The finishing temperature of hot rolling was 800° C. and the resultant 4 mm thick hot rolled bands were cooled to room temperature. Subsequently, several of the hot rolled bands were subjected to a continuous annealing by the N pattern method illustrated in FIG. 6, wherein the hot rolled bands were heated to 1000° C. ($H_1$ temperature) so as to recrystallize the same, and then cooled to 800° C. ($H_2$ temperature) at a rate of 10° C./second or less, followed by rapidly cooling to room temperature. Several hot rolled bands were subjected to a continuous annealing by the S pattern method, wherein they were held at 900° C. ($H_1$ temperature) followed by cooling. The other hot rolled bands were box-annealed and held at 840° C. over a period of 6 hours and then furnace cooled. This heat treatment pattern is herein referred to as the R pattern method and is schematically illustrated in FIG. 6.

Figure 7:
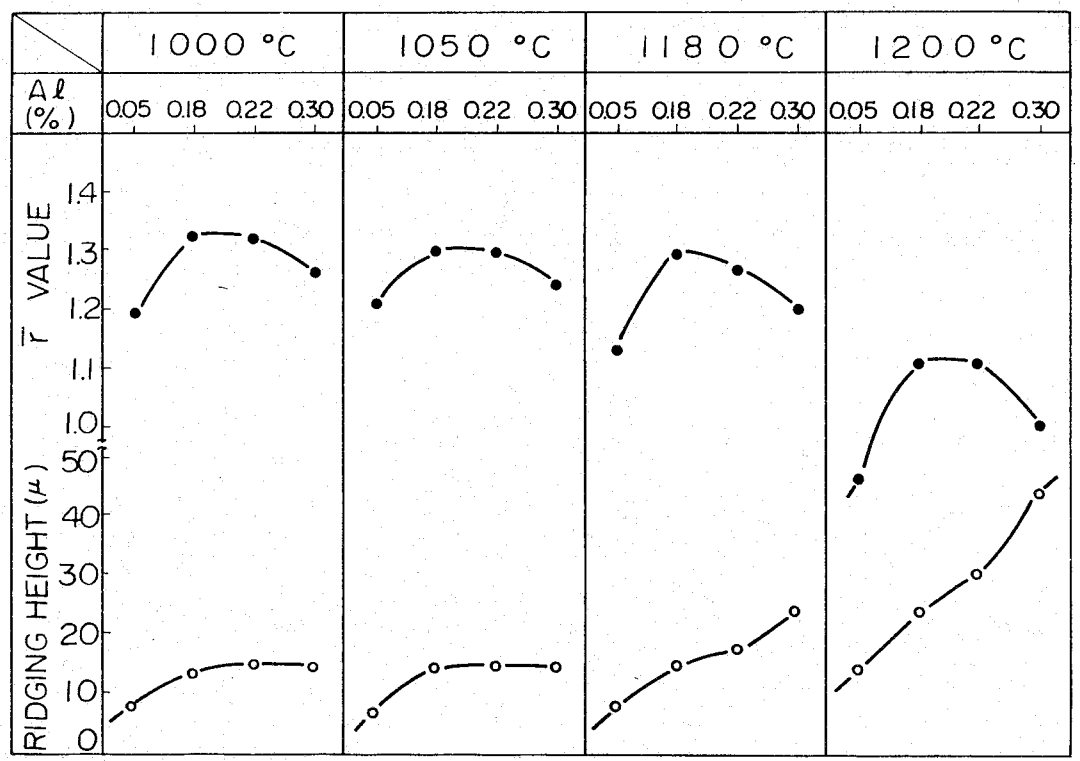
FIG. 7 is a drawing illustrating the influence of the aluminum content and the heating and holding temperature of a slab upon the $\bar{r}$ value and the ridging height.

The hot rolled bands, which were annealed by the above heat treatment patterns, were cold reduced to the thickness of 0.7 mm by a known one stage cold rolling method. In FIG. 7, the properties of the 0.7 mm thick final products are illustrated. The temperatures of 1000°, 1050°, 1180° and 1200° C. given in FIG. 7 are the heating and holding temperature of CC slabs. The maximum draft of hot rolling was 25%/pass and the annealing was performed according to the N pattern method ($H_1$ temperature; 1000° C. and $H_2$ temperature; 800° C.) with regard to the final products, the properties of which are illustrated in FIG. 7.

As can be understood from FIG. 7, the aluminum content of up to 0.2% is appropriate from the view point of improving the $\bar{r}$ value and ridging height, and such improvement effect tends to saturate or decrease at an aluminum content of more than 0.2%. In addition, the heating and holding temperature must be kept at 1200° C. at the highest, in order that improvement effect of the $\bar{r}$ value and ridging height can be maintained.

Figure 8:
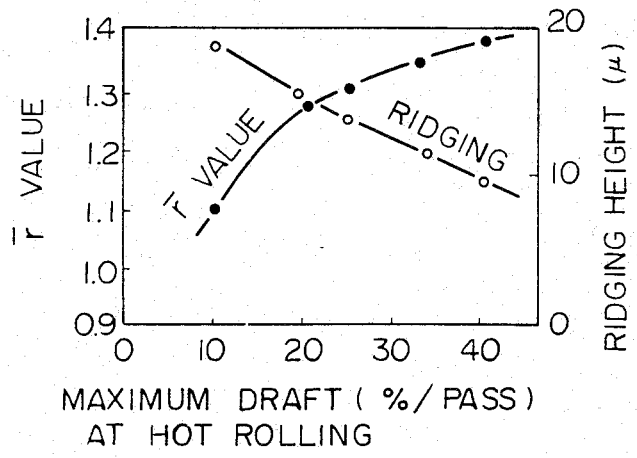
FIG. 8 is a graph illustrating the relationship of both the $\bar{r}$ value and the ridging height depending upon the maximum draft (%/pass) at hot rolling.

In FIG. 8 there are illustrated the properties of the final products produced under the conditions: the heating and holding temperature of the CC slab at 1050° C.; the heat treatment pattern N method ($H_1$ temperature: 1000° C., and $H_2$ temperature: 800° C.); and the maximum draft during hot rolling ranging from 10 to 40%/pass. As understood from FIG. 8, the $\bar{r}$ value is enhanced and the anti-ridging property is improved at the maximum draft during hot rolling amounting to at least 20%/pass.

The properties of a ferritic stainless steel produced by the method of the present invention are illustrated in Table 2, below, in comparison with those of the conventional method. The properties obtained by the method of present invention are superior to those of the conventional method.

TABLE 2

| | Al Content (%) | Heating and Holding Temperature of Slab (°C.) | Maximum Draft (%/pass) | Annealing of Hot Rolled Band | $\bar{r}$ value and Ridging Height: One Stage Cold Rolling | $\bar{r}$ value and Ridging Height: Two Stage Cold Rolling |
|---|---|---|---|---|---|---|
| Invention | 0.18 | 1050 | 30 | N | $\bar{r}$ = 1.32<br>Ridging = 15μ | 1.48<br>8μ |
| | 0.18 | 1050 | 30 | S | $\bar{r}$ = 1.31<br>Ridging = 15.6μ | 1.48<br>10μ |
| | 0.18 | 1050 | 30 | R | $\bar{r}$ = 1.28<br>Ridging = 17μ | 1.44<br>10μ |
| Conventional | 0.05 | 1220 | 15 | R | $\bar{r}$ = 0.98<br>Ridging = 18.3μ | 1.31<br>13μ |

EXAMPLE 2

Steels, given in Table 3, below, were melted and continuously cast in order to obtain the equiaxed crystal ratio of the resultant CC slabs amounting to 50% or more ($\theta \geqq 50\%$).

TABLE 3

| Sample Nos. | Chemical Composition: C | Si | Mn | P | S | Ni | Cr | N* | Al | Ti | B* | Others | Equiaxed Crystal Ratio θ (%) |
|---|---|---|---|---|---|---|---|---|---|---|---|---|---|
| 5 | 0.05 | 0.30 | 0.12 | 0.029 | 0.008 | 0.11 | 16.51 | 121 | 0.09 | 0.06 | 10 | — | 70 |
| 6 | 0.04 | 0.32 | 0.18 | 0.028 | 0.007 | 0.11 | 16.49 | 109 | 0.08 | 0.07 | 11 | V 0.10 | 71 |
| 7 | 0.05 | 0.33 | 0.15 | 0.022 | 0.006 | 0.12 | 16.49 | 108 | 0.09 | 0.06 | 9 | Nb 0.09 | 73 |
| 8 | 0.06 | 0.31 | 0.13 | 0.022 | 0.005 | 0.11 | 16.51 | 112 | 0.08 | 0.05 | 12 | Cu 0.18 | 71 |
| 9 | 0.05 | 0.33 | 0.13 | 0.021 | 0.006 | 0.11 | 16.49 | 118 | 0.07 | 0.07 | 13 | Zr 0.09 | 70 |
| 10 | 0.05 | 0.31 | 0.14 | 0.027 | 0.006 | 0.13 | 16.45 | 119 | 0.08 | 0.05 | 14 | Ca 0.008 | 71 |
| 11 | 0.05 | 0.32 | 0.12 | 0.025 | 0.007 | 0.11 | 16.61 | 112 | 0.09 | 0.06 | 11 | Ce 0.006 | 70 |

Note: The content of asterisked components is in ppm.

The CC slabs were heated to and held at temperatures of 1000°, 1050°, 1100°, 1150°, 1180° and 1220° C. and then hot rolled in such a screw down manner that the draft of at least one pass amounted to from 10%/pass to 40%/pass at the maximum. The finishing temperature of hot rolling was 800° C. and the resultant 4 mm thick hot rolled bands were cooled to room temperature. The hot rolled bands were then continuously annealed by the same N and S pattern methods as in Example 1. Final products 0.7 mm in thickness were obtained by subjecting the annealed hot bands to cold rolling and then annealing. In the following Table 4, the representative material properties of the final products are shown.

TABLE 4

| | Sample Nos. | Heating and Holding Temperature of Slab (°C.) | Maximum Draft (%/pass) | Annealing Pattern | $\bar{r}$ Value | Ridging Height (μ) |
|---|---|---|---|---|---|---|
| Invention | 5 | 1050 | 35 | N($H_1$: 1000° C.→ $H_2$:800° C.) | 1.40 | 6 |
| | 6 | " | " | N($H_1$: 1000° C.→ $H_2$:800° C.) | 1.45 | 6 |
| | 7 | " | " | N($H_1$: 1000° C.→ $H_2$:800° C.) | 1.45 | 5 |
| | 8 | " | " | S(900° C.) | 1.43 | 8 |
| | 9 | " | " | " | 1.50 | 6 |
| | 10 | " | " | " | 1.38 | 10 |
| | 11 | " | " | " | 1.35 | 11 |
| Conventional | 5 | 1220 | 15 | S(850° C.) | 1.18 | 15 |

The $\bar{r}$ value of the final products obtained by the method of invention is higher than and the ridging height is lower than the $\bar{r}$ value and ridging height, respectively, of the final product obtained by the conventional method. As understood from this fact, the deep drawability of the final products according to the present invention is improved.

Figure 9:
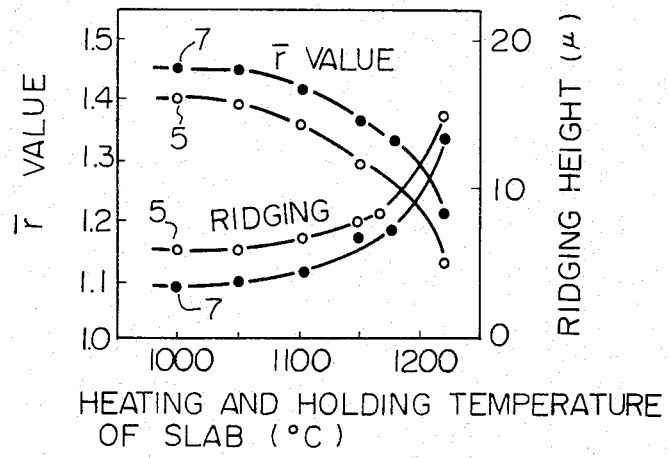
FIG. 9 is a graph illustrating the relationship of both the $\bar{r}$ value and the ridging height depending upon the heating and holding temperature of a slab; and, FIG. 10 is a graph illustrating the relationship of both $\bar{r}$ value and ridging height depending upon the maximum draft (%/pass) at hot rolling.

Referring to FIG. 9, the properties of Samples No. 5 and 7 are illustrated under the following conditions: the maximum draft during hot rolling 35%/pass; and, the heat treatment being the N pattern method. As understood from FIG. 9, the heating and holding temperature of a slab is preferably 1200° C. or lower and both the r value and anti-ridging property are deteriorated when the slab is heated above 1200° C.

Figure 10:
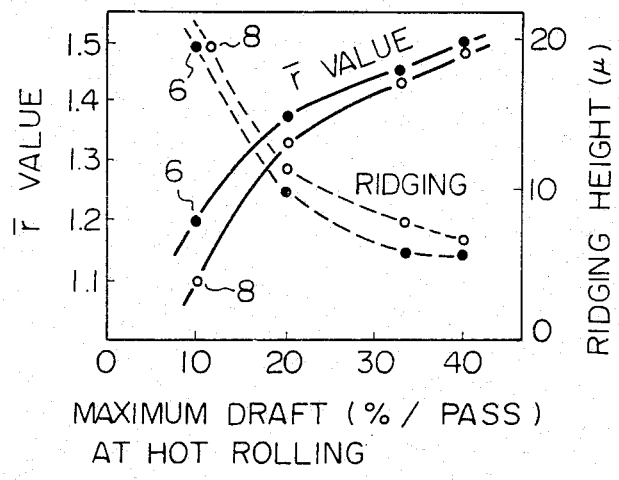

Referring to FIG. 10, the properties of Samples No. 6 and 8 are illustrated under the following condition: the heating and holding temperature of a slab at 1050° C., and; the hot band annealing being the S pattern method. As understood from FIG. 10, an appropriate maximum draft at hot rolling is 20%/pass or more.

EXAMPLE 3

Steels with a chemical composition as shown in Table 5 below, were melted and were continuously cast in order to obtain an equiaxed crystal ratio of the resultant CC slabs amounting to 50% or more ($\theta \geqq 50\%$).

TABLE 5

| Sample Nos. | Chemical Composition (%) C | Si | Mn | P | S | Ni | Cr | N* | Al | Equiaxed Crystal Ratio $\theta$ (%) |
|---|---|---|---|---|---|---|---|---|---|---|
| 12 | 0.05 | 0.30 | 0.15 | 0.023 | 0.008 | 0.12 | 16.49 | 111 | 0.05 | 71 |
| 13 | 0.05 | 0.31 | 0.13 | 0.025 | 0.007 | 0.11 | 16.51 | 121 | 0.15 | 75 |

Note: The content of the asterisked composition is in ppm.

The CC slabs were heated to and held at temperatures of 850°, 900°, 1000°, 1050°, 1100°, 1170°, 1200° and 1250° C. and then hot rolled in such a screw down manner that the draft of at least one pass was from 10%/pass to 40%/pass at the maximum. After cooling of the hot rolled bands, these were annealed at a temperature range between 600° and 1100° C. over a period of 1 minute. Subsequently, 0.7 mm thick final products were obtained by conventional cold rolling and then finishing-annealing. The properties of the final products were as given in Table 6.

TABLE 6

| | Sample Nos. | Heating and Holding Temperature of Slab (°C.) | Maximum Draft at Hot Rolling (%/pass) | Impact Value of Hot Rolled Band (kg-m/cm$^2$) | Annealing Temperature (°C.) | $\bar{r}$ Value | Ridging Height ($\mu$) |
|---|---|---|---|---|---|---|---|
| Invention | 12 | 1050 | 35 | 8 | 850 | 1.1 | 16 |
| | 13 | " | " | 10 | 880 | 1.3 | 8 |
| Conventional | 12 | 1100 | 10 | 5 | 1000 | 0.9 | 19 |

As understood from Table 6, the $\bar{r}$ value and anti-ridging property of the final products obtained by the method of the present invention are superior to those of the conventional method.

EXAMPLE 4

The CC slabs of steels with the chemical composition shown in Table 7 were produced.

TABLE 7

| Sample Nos. | Chemical Composition (%) C | Si | Mn | P | S | Ni | Cr | N* | Al | Ti | B* | Others | Equiaxed Crystal Ratio $\theta$ (%) |
|---|---|---|---|---|---|---|---|---|---|---|---|---|---|
| 14 | 0.04 | 0.31 | 0.12 | 0.029 | 0.008 | 0.11 | 16.51 | 112 | 0.09 | 0.06 | 10 | — | 72 |
| 15 | 0.05 | 0.33 | 0.18 | 0.028 | 0.007 | 0.12 | 16.50 | 112 | 0.08 | 0.05 | 11 | V 0.09 | 73 |
| 16 | 0.05 | 0.32 | 0.15 | 0.026 | 0.006 | 0.13 | 16.51 | 131 | 0.08 | 0.06 | 9 | Nb 0.08 | 71 |
| 17 | 0.05 | 0.31 | 0.13 | 0.025 | 0.008 | 0.13 | 16.51 | 118 | 0.07 | 0.07 | 10 | Cu 0.19 | 71 |
| 18 | 0.04 | 0.30 | 0.13 | 0.023 | 0.008 | 0.14 | 16.49 | 119 | 0.09 | 0.07 | 10 | Zr 0.08 | 73 |
| 19 | 0.04 | 0.30 | 0.12 | 0.028 | 0.009 | 0.12 | 16.48 | 121 | 0.09 | 0.06 | 11 | Ca 0.008 | 69 |
| 20 | 0.04 | 0.31 | 0.16 | 0.029 | 0.007 | 0.12 | 16.48 | 118 | 0.08 | 0.05 | 12 | Ce 0.005 | 68 |

Note: The content of the asterisked components is in ppm.

The CC slabs were heated to 1100° or 1230° C. and then hot rolled in such a screw down manner that the draft was 20 or 35%/pass for at least one pass. After cooling the hot rolled bands, they were annealed at a temperature range of from 900° to 1000° C. over a period of 1 minute.

Subsequently, the 0.7 mm thick final products were obtained by a conventional method of cold rolling and then finishing - annealing. The properties of these final products are given in Table 8.

TABLE 8

| | Sample Nos. | Heating and Holding Temperature of Slab (°C.) | Maximum Draft at Hot Rolling (%/pass) | Impact Value of Hot Rolled Sheet (kg-m/cm$^2$) | Annealing Temperature (°C.) | $\bar{r}$ Value | Ridging Height ($\mu$) |
|---|---|---|---|---|---|---|---|
| Invention | 14 | 1100 | 35 | 10 | 900 | 1.35 | 7 |
| | 15 | 1100 | 35 | 12 | 900 | 1.40 | 5 |
| | 16 | 1100 | 35 | 11 | 900 | 1.41 | 5 |
| | 17 | 1100 | 35 | 13 | 900 | 1.43 | 7 |
| | 18 | 1100 | 35 | 11 | 900 | 1.48 | 6 |
| | −19 | 1100 | 35 | 13 | 900 | 1.38 | 7 |
| | −20 | 1100 | 35 | 13 | 900 | 1.40 | 7 |
| Conventional - | 14 | 1230 | 20 | 5 | 1000 | 1.0 | 16 |

The $\bar{r}$ value and ridging height of the samples produced by the method of present invention are superior to those of the conventional method.

As described hereinabove, particularly in the Examples, the ferritic stainless steel produced by the method of the present invention exhibits deep drawability and anti-ridging properties equivalent or superior to those of such steel produced by the conventional method. In addition to box annealing, the continuous annealing is possible for the hot rolled band annealing, and either one step or two step cold rolling is possible for cold rolling of the hot band, according to a feature of the present invention.

We claim:

1. A method for producing ferritic stainless steel sheets or strips with reduced ridging, which comprises:

heating a slab of a ferritic stainless steel containing up to 0.2% of Al, the Al content being at least twice the N content, at a temperature of not more than 1200° C., and, then, hot rolling said slab of ferritic stainless steel at at least one pass of screw down at a draft of not less than 20% pass, whereby precipitation of AlN and partial recrystallization of said ferritic stainless steel occurs.

2. A method for producing a stainless steel sheets or strips according to claim 1, characterized in that said ferritic stainless steel contains from 15 to 20% of chromium and up to 0.2% of aluminum, the aluminum content being at least twice the nitrogen content.

3. A method for producing ferritic stainless steel sheets or strips according to claim 1, characterized in that said ferritic stainless steel contains up to 0.2% of aluminum, from 15 to 20% of chromium, from 0.005 to 0.6% of titanium and from 0.0002 to 0.0030% of boron.

4. A method for producing ferritic stainless steel sheets or strips according to claim 3, characterized in that said ferritic stainless steel further contains up to 0.05% of at least one element selected from the group consisting of calcium and cerium.

5. A method for producing ferritic stainless steel sheets or strips according to claim 2 or 3, characterized in that said ferritic stainless steel further contains from 0.005 to 0.40% of at least one element selected from the group consisting of niobium, vanadium and zirconium.

6. A method for producing ferritic stainless steel sheets or strips according to claim 2 or 3 characterized in that said ferritic stainless steel further contains from 0.02 to 0.50% of copper.

7. A method for producing ferritic stainless steel sheets or strips according to claim 5, characterized in that said ferritic stainless steel further contains from 0.02 to 0.50% of copper.

8. A method for producing ferritic stainless steel sheets or strips according to claim 5, characterized in that said ferritic stainless steel further contains up to 0.05% of at least one element selected from the group consisting of calcium and cerium.

9. A method for producing ferritic stainless steel sheets or strips according to claim 1, characterized in that a hot rolled band is continuously annealed and, after the continuous annealing, the hot rolled band is cold rolled and finishing-annealed.

10. A method for producing ferritic stainless steel sheets or strips according to claim 9, wherein the hot rolled band is continuously annealed at a temperature of from 700° to 1050° C.

11. A method for producing ferritic stainless steel sheets or strips according to claim 10, characterized in that said hot rolled band is heated to the annealing temperature in the range of from 700° to 1050° C. and then cooled to a temperature in the range of from 700° to 1050° C. and then cooled to a temperature of from 700° to 900° C. at a cooling rate of not more than 15° C./second, followed by cooling to the room temperature.

12. A method for producing ferritic stainless steel sheets or strips according to claim 8, characterized in that said hot rolled band is heated to a temperature in the range of from 700° to 900° C. and is rapidly cooled, directly after the heating to said temperature range.

13. A method for producing ferritic stainless steel sheets or strips according to claim 3, wherein the hot rolled band is continuously annealed at a temperature of from 800° to 1050° C.

* * * * *